US008387199B2

(12) United States Patent
Mayer et al.

(10) Patent No.: US 8,387,199 B2
(45) Date of Patent: Mar. 5, 2013

(54) DEVICE AND METHOD FOR COUPLING A CLEANING IMPLEMENT TO A FLOOR CLEANING MACHINE

(75) Inventors: Heinrich-Tito Mayer, Jonschwil (CH); Franz Oberhaensli, Mosnang (CH)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 13/346,365

(22) Filed: Jan. 9, 2012

(65) Prior Publication Data

US 2012/0174329 A1 Jul. 12, 2012

Related U.S. Application Data

(66) Continuation of application No. 12/162,407, filed as application No. PCT/US2007/061439 on Feb. 1, 2007, now Pat. No. 8,091,171, Substitute for application No. 60/764,316, filed on Feb. 1, 2006.

(51) Int. Cl.
*B08B 9/38* (2006.01)

(52) U.S. Cl. ..... 15/176.1; 15/202

(58) Field of Classification Search ..... 15/49.1, 15/98, 176.1, 176.4–176.6, 202
See application file for complete search history.

(56) References Cited

U.S. PATENT DOCUMENTS

| | | | | |
|---|---|---|---|---|
| 3,115,660 | A | 12/1963 | Hunt | |
| 3,216,035 | A | 11/1965 | Gaudry | |
| 3,996,639 | A | 12/1976 | Griffin et al. | |
| 5,398,366 | A | 3/1995 | Bradley | |
| 5,419,007 | A | 5/1995 | Hult et al. | |
| 5,806,132 | A | 9/1998 | Kelley | |
| 6,032,313 | A | 3/2000 | Tsang | |
| 6,647,578 | B2 * | 11/2003 | Morgan et al. | 15/49.1 |
| D546,007 | S | 7/2007 | Hinder et al. | |
| D556,403 | S | 11/2007 | Hinder et al. | |
| D602,660 | S | 10/2009 | Hinder et al. | |
| 2004/0187238 | A1 | 9/2004 | Young | |

FOREIGN PATENT DOCUMENTS

| | | |
|---|---|---|
| DE | 19728927 | 11/1998 |
| JP | 3103066 | 10/1991 |
| JP | 8131387 | 5/1996 |
| WO | 2005112729 | 12/2005 |

OTHER PUBLICATIONS

PCT US2007061439 EPO International Search Report dated Oct. 9, 2007, 3 pages.

* cited by examiner

*Primary Examiner* — Laura C Guidotti
(74) *Attorney, Agent, or Firm* — Michael Best & Friedrich LLP

(57) ABSTRACT

A device and method for coupling a cleaning implement to a floor cleaning machine. The device includes a plate that has a first edge, a second edge, and a main body portion extending between the first edge and the second edge. The device also includes projections and recesses positioned to releasably engage with each other to releasably couple the plate with the cleaning implement, and a channel that is coupled to one of the first edge and the second edge of the plate to receive an edge of the cleaning implement. The channel has a first end for initially receiving the edge of the cleaning implement during insertion, and a second end positioned opposite the first end. A retainer is in communication with the channel to selectively prevent the cleaning implement from disengaging relative to the coupling device.

20 Claims, 9 Drawing Sheets

A-A

A-A

DEVICE AND METHOD FOR COUPLING A CLEANING IMPLEMENT TO A FLOOR CLEANING MACHINE

RELATED APPLICATIONS

This application claims priority to U.S. patent application Ser. No. 12/162,407 filed Jul. 28, 2008, which is a U.S. National Stage entry of International Patent Application No. PCT/US2007/061439 filed Feb. 1, 2007, which claims priority to U.S. Provisional Application No. 60/764,316 filed Feb. 1, 2006, the entire contents of all of which are hereby incorporated by reference.

BACKGROUND OF THE INVENTION

The present invention relates to a device and method for coupling a floor cleaning implement to a floor cleaning machine. The floor cleaning machine can be one of many types of floor cleaning and treating machines, such as scrubbers, sweepers, and the like. These types of machines can be used for the cleaning of hard surfaces of large floor areas in hotels, factories, office buildings, shopping centers and the like.

In general such machines comprise a movable body supported by a pair of drive wheels and one or more caster wheels. With a scrubber, the body carries a scrubbing device, reservoirs for storing fresh and spent cleaning liquid, a device for dosing fresh cleaning liquid onto the floor, and a squeegee/vacuum pickup system for recovering spent cleaning liquid from the floor.

The scrubbing device normally comprises one or more cleaning implements, such as brushes or scrubbing pads and a motor for driving the implements.

Since the pads of a floor cleaning machine are replaced frequently due to wear or the need to use a pad with different abrasive characteristics, it is important that the retainer portion of the coupling device be easily released.

SUMMARY OF THE INVENTION

The present invention relates to a device and method for coupling a floor cleaning implement to a floor cleaning machine. The device and method selectively couple a floor cleaning implement, such as a pad or brush, in manner that can be easily released and connected.

One embodiment of the present invention provides a device for coupling a cleaning implement to a floor cleaning machine. The coupling device includes a plate having a first edge, a second edge, and a main body portion extending between the first edge and the second edge. The device also includes projections and recesses that are positioned to releasably engage each other to releasably couple the plate with the cleaning implement. A channel is coupled to one of the first edge and the second edge of the plate to receive an edge of the cleaning implement. The channel has a first end for initially receiving the edge of the cleaning implement during insertion, and a second end positioned opposite the first end. A retainer is in communication with the channel to selectively prevent the cleaning implement from disengaging relative to the coupling device.

In some embodiments, the main body portion has a plurality of concave recesses dimensioned and configured to selectively receive convex projections extending from the cleaning implement. The projections of the cleaning implement only fully engage the recesses of the coupling device when the actuator presses the cleaning implement against a floor.

In other embodiments, the main body portion has a plurality of substantially convex projections extending toward the cleaning implement. The projections are dimensioned and configured to be selectively received within substantially concave recesses on the cleaning implement. The recesses of the cleaning implement only fully engage the projections of the coupling device when the actuator presses the cleaning implement against a floor.

Another embodiment is directed toward a device for coupling a cleaning implement to a floor cleaning machine. The coupling device includes a plate that has a first edge, a second edge opposite the first edge, and a main body portion extending between the first edge and the second edge. The device also includes a first channel at the first edge of the plate to receive a first edge of the cleaning implement, and a second channel at the second edge of the plate to receive a second edge of the cleaning implement. The first edge of the cleaning implement is slidably received into an end of the first channel of the plate, and the second edge of the cleaning implement is slidably received into an end of the second channel of the plate to install the cleaning implement. A projection is movable between a first position in which the projection prevents removal of the cleaning implement from the plate, and a second position in which the cleaning implement is slidably removable from the plate.

Another embodiment is directed toward a floor cleaning machine. The floor cleaning machine includes a frame, an actuator coupled to the frame, a coupling device coupled to the actuator, and a cleaning implement coupled to the coupling device. The coupling device has a plate with a main body portion that defines an edge, and a channel is coupled to the edge of the plate. The cleaning implement includes a first surface adapted to contact and clean a floor surface, and a second surface positioned substantially opposite the first surface and contacting the plate. The cleaning implement also has a fixation portion that is engageable with the coupling device within the channel to hold the cleaning implement on the coupling device, and a retainer that is in communication with the channel to selectively prevent the cleaning implement from disengaging relative to the coupling device.

Further aspects of the present invention, together with the organization and operation thereof, will become apparent from the following detailed description of the invention when taken in conjunction with the accompanying drawings.

BRIEF DESCRIPTION OF THE DRAWINGS

FIG. 4 is a side view of the coupling device shown in FIG. 2.

FIG. 5 is a side cross-sectional view of the coupling device shown in FIG. 3 with the cross-section taken along line A-A.

FIG. 6 is a front cross-sectional view of the coupling device shown in FIG. 3 with the cross-section taken along line B-B.

DETAILED DESCRIPTION

Figure 1:
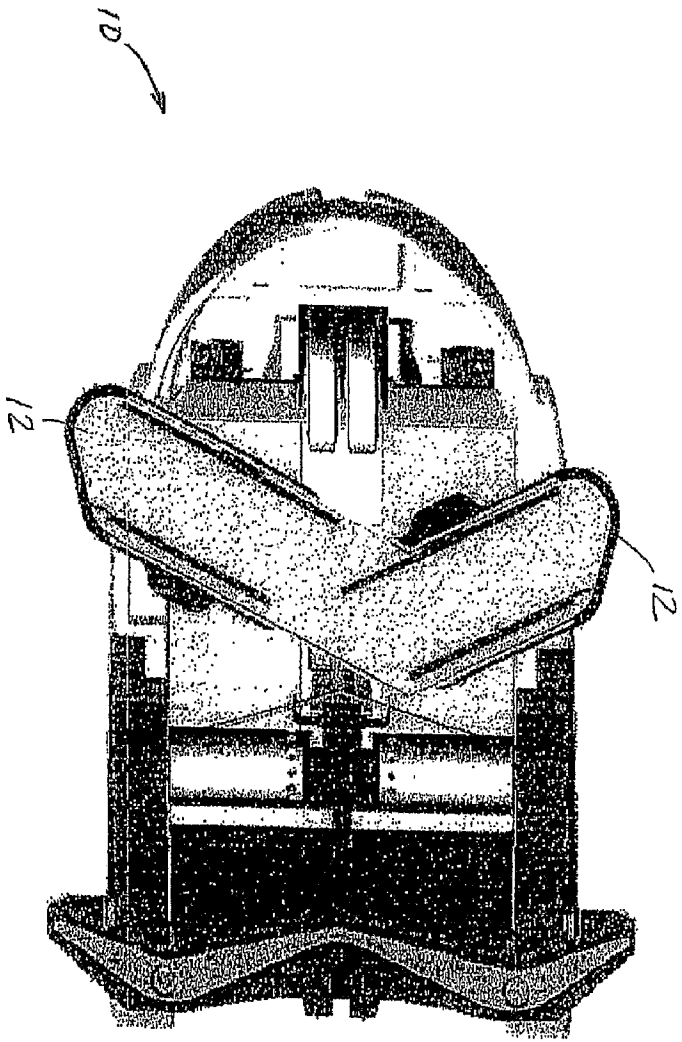
FIG. 1 is bottom view of an exemplary floor cleaning machine having a coupling device embodying aspects of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

Referring now to FIG. 1, a floor cleaning machine 10 is shown, comprising a device 12 used to couple cleaning implements 14, such as scrubbing pads and brushes, to the cleaning machine 10. Although one particular embodiment of the invention will be described in connection with a scrubber, it should be clear that the invention has application to other types of floor maintenance vehicles, such as sweepers and the like. Accordingly, the present invention should not be limited to a scrubber.

Referring now to FIGS. 2-6, one particular embodiment of the coupling device 12 is shown. As will be described in greater detail below, this illustrated coupling device 12 is adapted to move the cleaning implement 14 in an orbital or reciprocating motion. However, the principles shown herein can be adapted for rotary motion as well.

Figure 2:
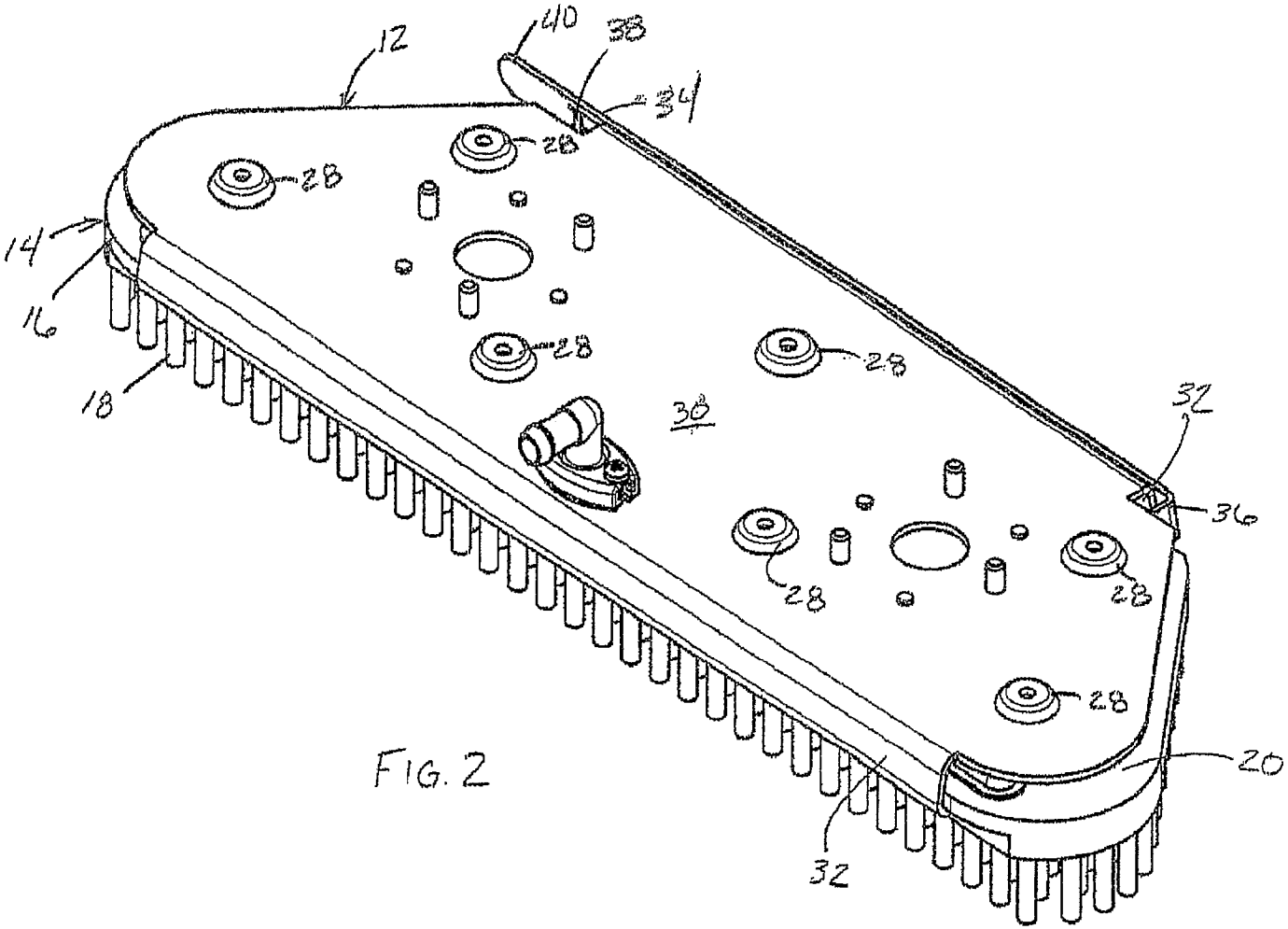
FIG. 2 is a perspective view of a coupling device embodying aspects of the present invention, wherein the coupling device is coupled to a floor cleaning implement.

As can be seen in FIG. 2, the cleaning implement 14 and coupling device 12 are generally elongated due to the orbital motion of this cleaning device. However, in other embodiments, the cleaning implement 14 can have a variety of other configurations, such as square, rectangular, circular, other polygonal shapes, and the like.

Figure 7:
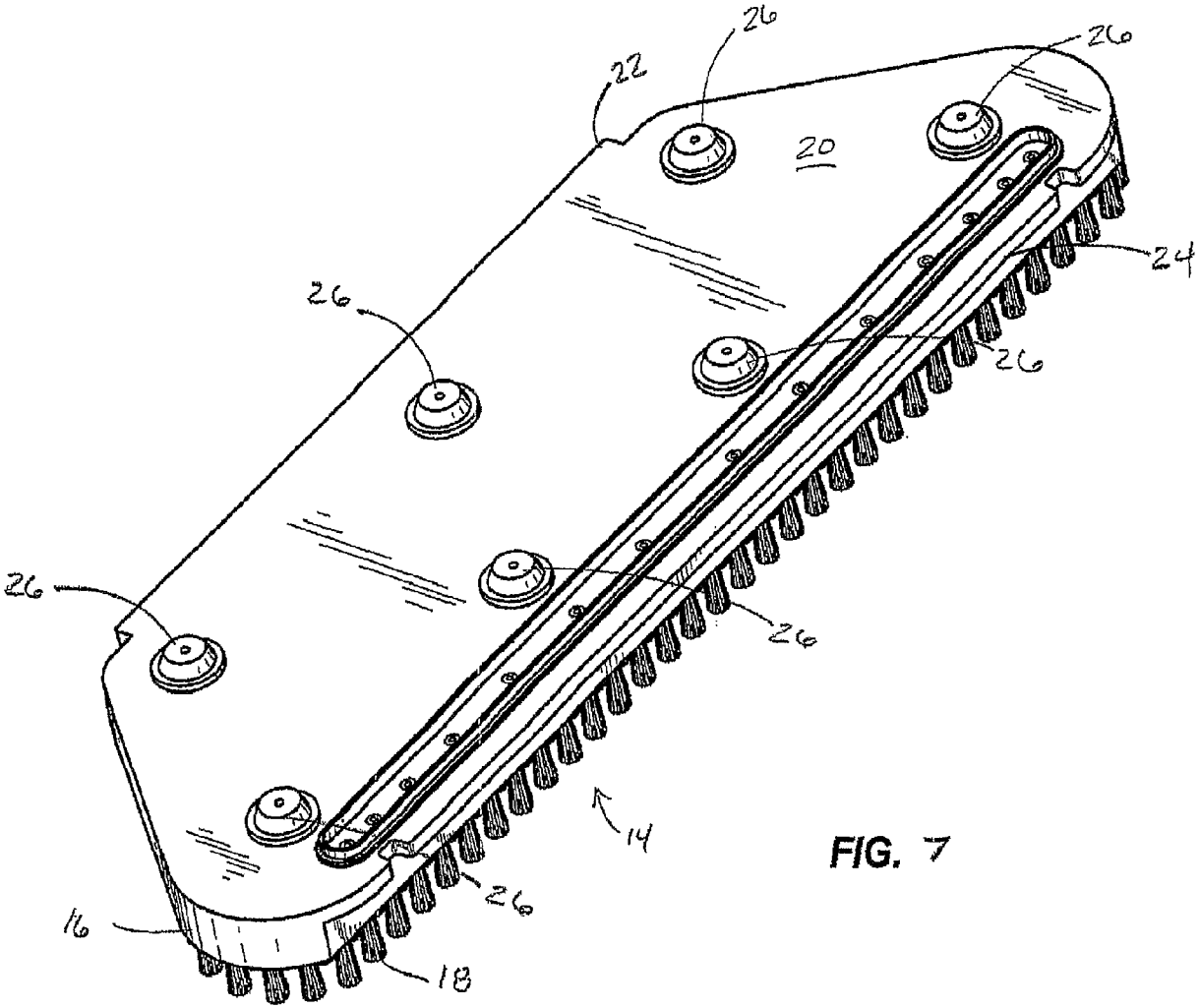
FIG. 7 is a perspective top view of a brush type cleaning implement embodying aspects of the present invention.
Figure 8:
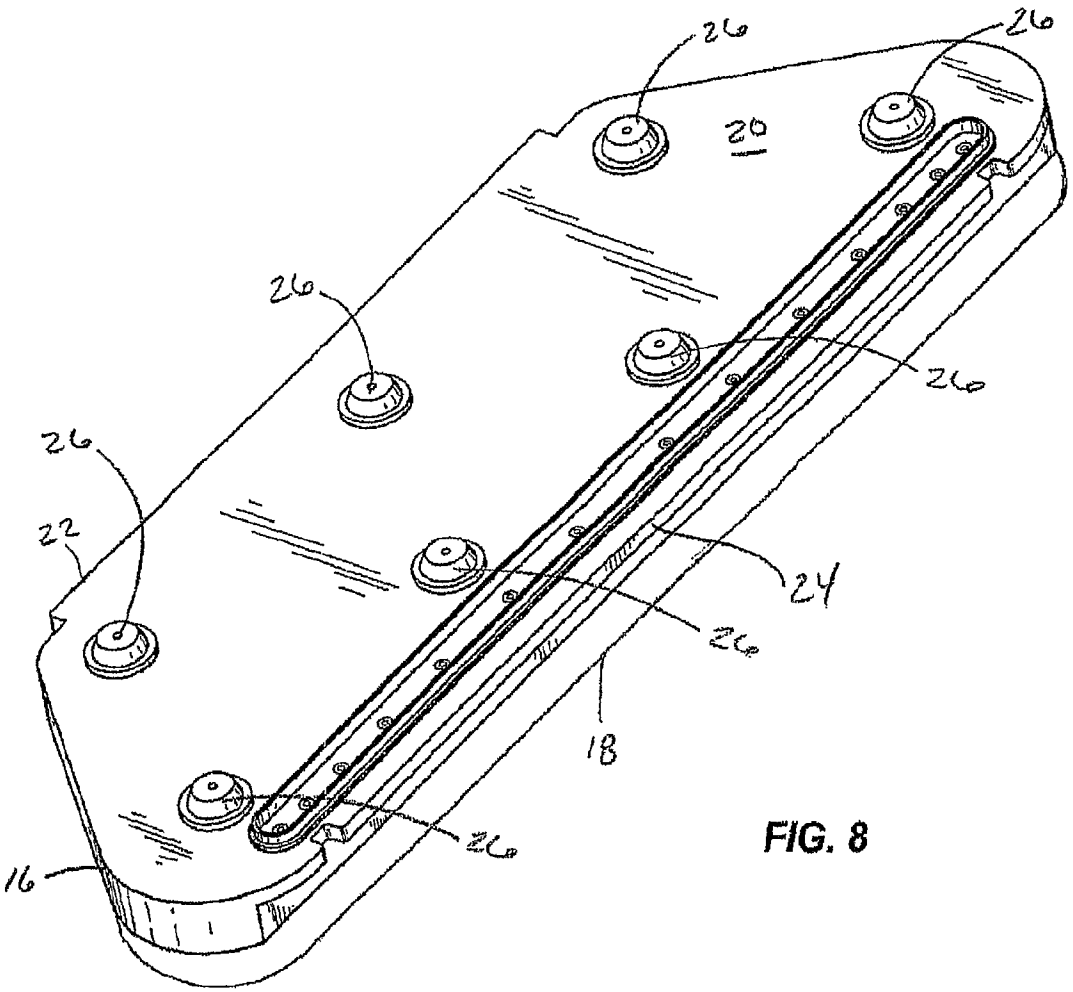
FIG. 8 is a perspective top view of a pad type cleaning implement embodying aspects of the present invention.

Two particular embodiments of the cleaning implement 14 are shown in FIGS. 7 and 8. FIG. 7 illustrates a brush type cleaning implement 14, while FIG. 8 illustrates a cleaning pad type cleaning implement 14. As shown in these figures, both cleaning implements 14 have substantially similar fixation portions 16 that are used to couple the brush or pad to the coupling device 12. The fixation portion 16 and the cleaning portion 18 of the illustrated embodiments are generally trapezoidal shaped, but other configurations are possible. The fixation portions 16 have a main body 20 having a first longitudinal edge 22 and a second longitudinal edge 24 positioned opposite the first longitudinal edge 22. The first and second longitudinal edges 22, 24 are slightly cantilevered over the cleaning element 18.

A plurality of locating members 26 are coupled to the top side of the fixation portion 16. These locating members 26 can be made from a variety of materials and can be configured many different ways. In the illustrated embodiment, the locating members 26 are rubber projections that have a generally convex shape. Specifically, the rubber projections have a dome-like or truncated cone configuration. As will be discussed below, this type of shape can help to locate or direct the locating members into receiving recesses 28 on the coupling device 12. The projections 26 of this embodiment are formed of rubber to help dampen noise between the cleaning implement 14 and the coupling device 12. Other materials, however, can be used for this same purpose.

Although the illustrated embodiment places the projecting locating members 26 on the fixation portion 16 of the cleaning implement 14 and the receiving recesses 28 on the coupling device 12, other embodiments can modify this configuration. For example, in some embodiments, the projections 26 can be placed on the coupling device 12, while the recesses 28 can be placed on the fixation portion 16 of the cleaning implement 14. Additionally, some embodiments can utilize a combination of projections 26 and recesses 28 on both the fixation portion 16 of the cleaning implement and the coupling device 12.

As shown in FIG. 2 and described in greater detail below, the cleaning implement 14, or more specifically, the fixation portion 16 of the cleaning implement 14 is received within the coupling device 12 to connect the cleaning implement 14 to the floor cleaning machine 10.

The coupling device 12 includes a main body 30 having a pair of slots or channels 32 for receiving the edges 22, 24 of the fixation portion 16 of the cleaning implement 14. The channels 32 are dimensioned and configured to receive the edges 22, 24 of the fixation portion 16. More specifically, as shown in FIGS. 4 and 5, the channels 32 are dimensioned to allow the fixation portion 16 to easily slide into the coupling device 12, without significant interference or engagement between the locating members 26 and the body 30 of the coupling device 12.

Figure 3:
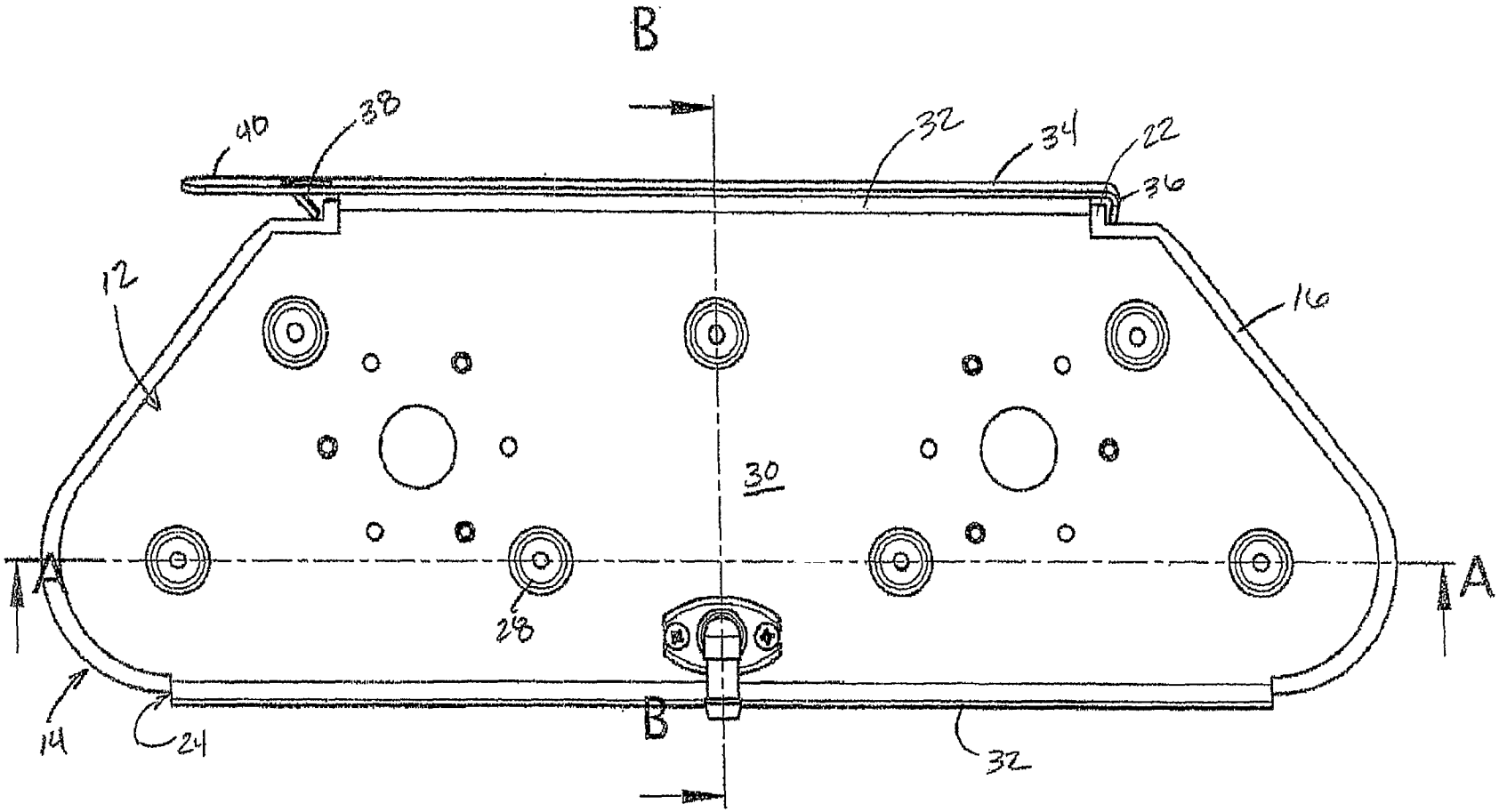
FIG. 3 is a top view of the coupling device shown in FIG. 2.

As shown in FIGS. 2 and 3, one of the channels 32 has a retainer 34 to selectively prevent the cleaning implement 14 from disengaging the coupling device 12. The retainer 34 includes a projection 36 positioned adjacent one end of the channel 32 and intersecting the path defined by the channel 32. The retainer 34 also includes another projection 38 positioned adjacent the other end of the channel 32 and intersecting the path defined by the channel 32. At least one of the projections 36, 38 is selectively moveable to a non-intersecting position to allow the cleaning implement 14 to be removed from the coupling device 12. In the illustrated embodiment, only one projection 38 is selectively moveable. This projection 38 is provided with a lever 40 to provide leverage for an operator to elastically deform the retainer 34 or otherwise move the projection 38. As further illustrated in FIG. 3, the projection 38 located at this end is angled to allow a cleaning implement 14 to be inserted without manually moving the projection 38 with the lever 40. Rather, due to the angled configuration of the projection 38, the projection 38 will naturally be forced outward when engaged by the edge 22 of the fixation portion 16 of the cleaning implement 14 during insertion.

In the illustrated embodiment, the retainer 34 is formed separate from the channel 32 and is attached to the channel 32 in a secondary operation, such as welding. However, in other embodiments, the retainer 34 can be integrally formed into the channel 32 or the main body portion 30.

As shown in FIGS. 2-6, the main body portion 30 of the coupling device 12 is provided with a plurality of recesses 28. These recesses 28 are dimensioned and configured to selectively house or receive portions of the projections 26 extending from the top of the cleaning implement 14. The recesses 28 have a generally concave configuration to receive the projections 26. The generally concave recesses 28 have a dome-like configuration or some what conical configuration, much like the configuration of the projections 26 on the cleaning implement 14. Further, the recesses 28 are generally positioned and spaced apart in substantially the same configuration as the projections 26 on the cleaning implement 14.

In operation, a cleaning implement 14, such as the brush shown in FIG. 7 can be coupled to the floor cleaning machine 10 via the coupling device 12 shown in FIGS. 2-6 as follows. First, the cleaning implement 14 is aligned with the coupling device 12. Specifically, the cantilevered edges 22, 24 of the fixation portion 16 of the cleaning implement 14 are aligned with the channels 32 of the coupling device 12. Once this alignment is substantially complete, the cleaning implement 14 can be inserted, pushed, driven, or otherwise forced into the channels 32 of the coupling device 12.

As the brush 14 enters the coupling device 12, one of the edges of the brush engages the angled projection 38 of the retainer 34 and forces the retainer to a position that allows the brush 14 to enter the channel 32. During the insertion process, the bottom surface of the cantilevered edges 22, 24 (i.e., the surface facing the floor during operation) preferably slides along the upward facing surface of the channel 32. With this type of engagement during the insertion process, the brush 14 should be easily inserted without the projections 26 on the brush interfering or substantially engaging the main body portion 30 of the coupling device 12. Once the brush 14 is inserted fully into the channel 32, the angled projection 38 can elastically return to its original position. In this position, the brush 14 is prevented from disengaging the coupling device 12, and more specifically, the cantilevered edge is prevented from backing out of the channel 32.

Figure 4A:
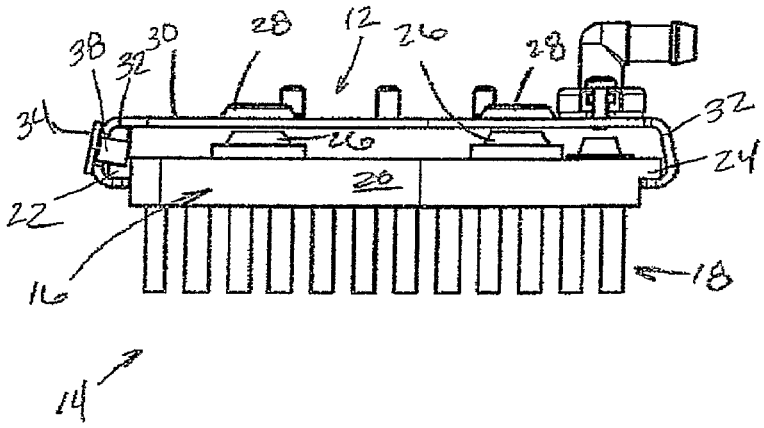
FIG. 4A shows a first position of the cleaning implement coupled to the coupling device.
Figure 4B:
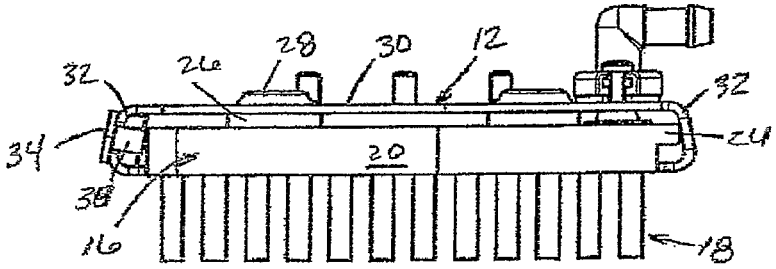
FIG. 4B shows a second position of the cleaning implement coupled to the coupling device.
Figure 5A:
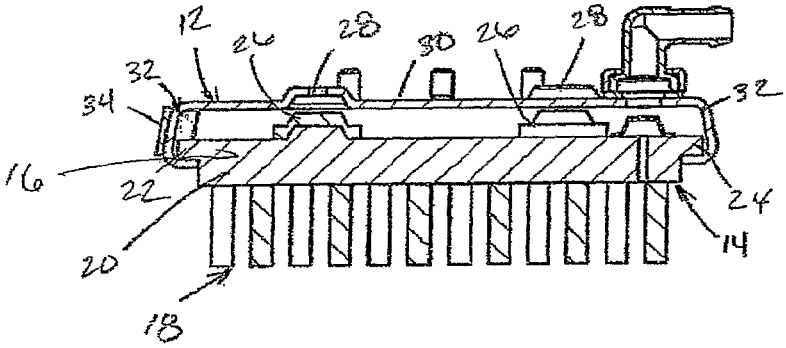
FIG. 5A corresponds to the position shown in FIG. 4A.
Figure 5B:
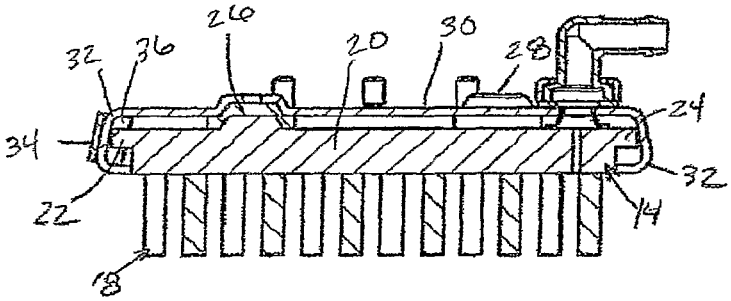
FIG. 5B corresponds to the position shown in FIG. 4B.
Figure 6A:
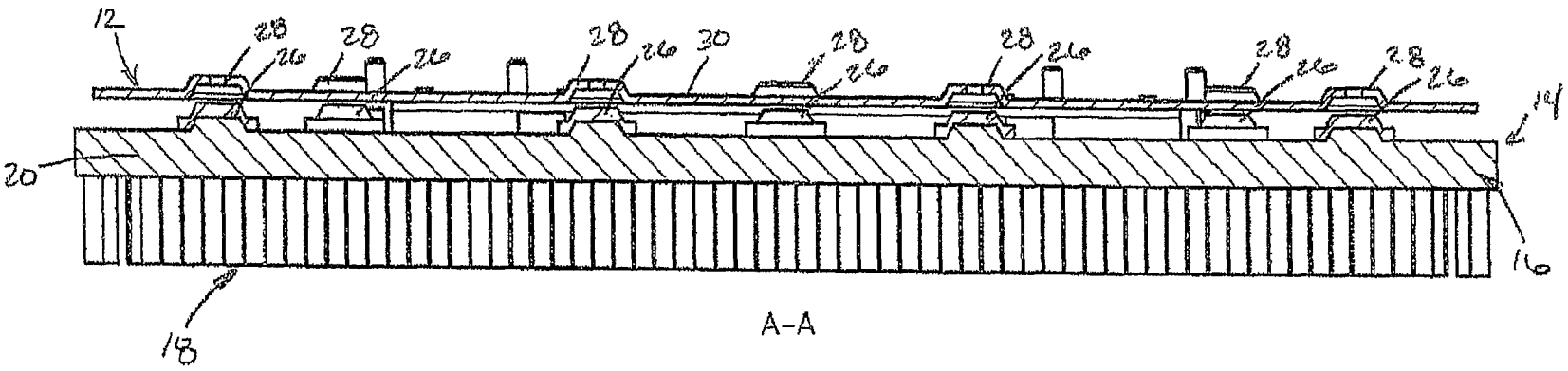
FIG. 6A shows the cleaning implement coupled to the coupling device corresponding to the position shown in FIG. 4A.
Figure 6B:
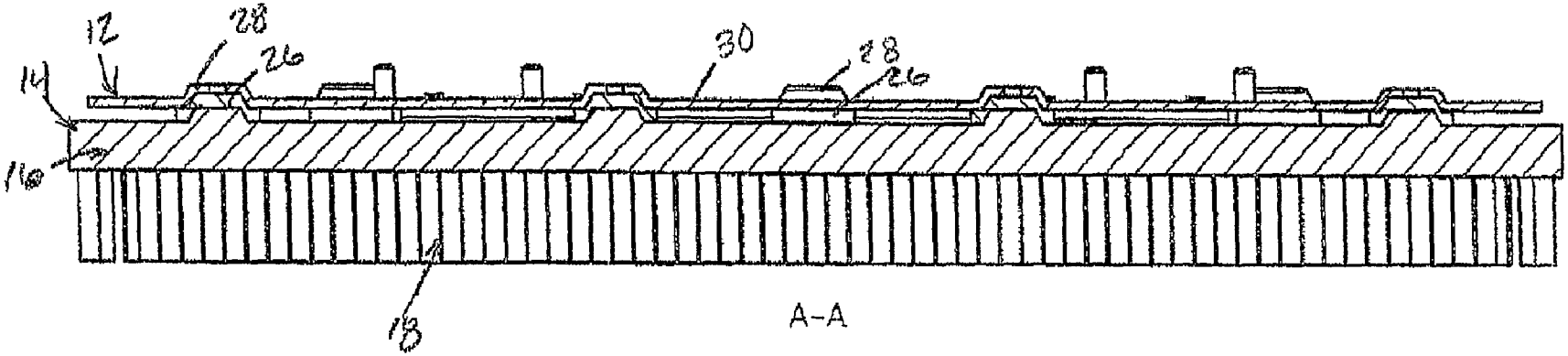
FIG. 6B shows the cleaning implement coupled to the coupling device corresponding to the position shown in FIG. 4B.

Once the brush 14 is fully inserted in the coupling device 12, it will rest within the coupling device 12 as shown in FIGS. 4A, 5A, and 6A. Specifically, the lower surface of the cantilevered edges 22, 24 will rest on the lower portion of the channel 32. Further, as shown in these figures, the projections 26 on top of the cleaning implement 14 will not be engaged with the recesses 28 of the coupling device 12. However, the projections 26 may be substantially aligned with the recesses 28 in this position.

When an operator chooses to utilize the brushes 14, the brush 14 and coupling device 12 will be lowered into contact with a floor. An actuator, such as a motor or motor and transmission assembly, can be used to lower the brush 14 and coupling device 12 to the floor. The actuator can be used to force the brush 14 against the floor with a desired pressure or force. This will cause the brush 14 to engage the coupling device 12 as shown in FIGS. 4A, 5A, and 6A. Specifically, the projections 26 extending from the top of the brush 14 engage the recesses 28 on the main body portion 30 of the coupling device 12. This engagement prevents the brush 14 from moving relative to the coupling device 12 when the brushes 14 are caused to actuate relative to the floor. Assuming that the projections 26 are not perfectly aligned with the recesses 28 prior to the brush 14 being placed in contact with the floor, the shape of the projections 26 and recesses 28 should encourage proper alignment and engagement. Specifically, the generally convex shape of the projections 26 combined with the concave shape of the recesses 28 can funnel or otherwise move the brush into proper alignment with the coupling device 12.

Once scrubbing operations are complete, the actuator can be actuated to lift the brush 14 and coupling device 12 off of the floor. Once the brush 14 is lifted off of the floor, the brush will rest within the coupling device 12 as shown in FIG. 4A.

To remove the brush 14 from the coupling device 12, the following steps can be used. A force can be applied to the lever 40 adjacent the angled projection 38 to move the projection 38 to a position in which it does not substantially intersect the path defined by the channel 32. Once the projection 38 is moved to a position where it does not hinder the removal the brush 14, the brush 14 can be removed from the coupling device 12 by pulling it in the opposite direction that it was inserted.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. A device for coupling a cleaning implement to a floor cleaning machine, the coupling device comprising:

a plate having a first edge, a second edge, and a main body portion extending between the first edge and the second edge;

projections and recesses positioned to releasably engage with each other to releasably couple the plate with the cleaning implement;

a channel coupled to one of the first edge and the second edge of the plate to receive an edge of the cleaning implement, the channel having a first end for initially receiving the edge of the cleaning implement during insertion and a second end positioned opposite the first end; and a retainer in communication with the channel to selectively prevent the cleaning implement from disengaging relative to the coupling device.

2. The coupling device of claim 1, wherein the retainer has a projection positioned adjacent at least one of the first end and the second end to retain the cleaning implement in engagement with the coupling device.

3. The coupling device of claim 2, wherein the projection is a first projection positioned adjacent the first end and a second projection is positioned adjacent the second end, and wherein at least one of the first projection and the second projection intersects the channel.

4. The coupling device of claim 3, wherein each of the first projection and the second projection intersects the channel, and wherein one of the first projection and the second projection is movable to a non-intersecting position to permit removal of the cleaning implement from the coupling device.

5. The coupling device of claim 2, wherein the projection is selectively movable between a first position in which the projection intersects the channel, and a second position in which the projection is in a non-intersecting position relative to the channel.

6. The coupling device of claim 5, wherein the projection includes a lever operable to move the projection from the first position to the second position.

7. The coupling device of claim 6, wherein the lever is elastically deformable.

8. The coupling device of claim 6, wherein the projection is varied from the first position to the second position in response to insertion of the cleaning implement into the channel.

9. A device for coupling a cleaning implement to a floor cleaning machine, the coupling device comprising:

a plate having a first edge, a second edge opposite the first edge, and a main body portion extending between the first edge and the second edge;

a first channel at the first edge of the plate to receive a first edge of the cleaning implement; and a second channel at the second edge of the plate to receive a second edge of the cleaning implement, wherein the first edge of the cleaning implement is slidably received into an end of the first channel of the plate and the second edge of the cleaning implement is slidably received into an end of the second channel of the plate to install the cleaning implement, and wherein a projection is movable between a first position in which the projection prevents removal of the cleaning implement from the plate, and a second position in which the cleaning implement is slidably removable from the plate.

10. The coupling device of claim 9, wherein the projection is located on one of the plate and the cleaning implement and is releasably engageable with the other of the plate and the cleaning implement.

11. The coupling device of claim 9, wherein the projection is positioned adjacent at least one of a first end and a second end of the second channel.

12. The coupling device of claim 11, wherein the projection is a first projection positioned adjacent the first end of the second channel, the coupling device further comprising a second projection positioned adjacent the second end of the second channel.

13. The coupling device of claim 12, wherein each of the first projection and the second projection intersects the second channel in the first position.

14. The coupling device of claim 9, wherein the projection is movable to the second position via an elastically deformable lever.

15. The coupling device of claim 9, wherein the projection is moved from the first position to the second position in response to insertion of the cleaning implement into the second channel.

16. A floor cleaning machine comprising:

a frame;

an actuator coupled to the frame;

a coupling device coupled to the actuator and including a plate having a main body portion defining an edge;

a channel coupled to the edge of the plate;

a cleaning implement coupled to the coupling device, the cleaning implement including a first surface adapted to contact and clean a floor surface and a second surface positioned substantially opposite the first surface and contacting the plate, the cleaning implement further including a fixation portion engageable with the coupling device within the channel to hold the cleaning implement on the coupling device; and a retainer in communication with the channel to selectively prevent the cleaning implement from disengaging relative to the coupling device.

17. The floor cleaning machine of claim 16, wherein the cleaning implement includes a cleaning element extending from the first surface, and wherein the fixation portion includes an edge cantilevered over the cleaning element.

18. The floor cleaning machine of claim 16, wherein the edge is disposed in the channel when the cleaning implement is installed on the coupling device.

19. The floor cleaning machine of claim 18, wherein the retainer includes a projection intersecting the channel to hold the cleaning implement on the coupling device.

20. The floor cleaning machine of claim 19, wherein the projection is selectively movable to a non-intersecting position to permit removal of the cleaning implement from the device.

* * * * *